United States Patent [19]

Guild

[11] 4,439,476

[45] Mar. 27, 1984

[54] TUFTED FABRICS AND METHOD OF MAKING

[75] Inventor: George A. Guild, Kirriemuir, Scotland

[73] Assignee: Don Brothers, Buist P.L.C., Scotland

[21] Appl. No.: 451,817

[22] Filed: Dec. 21, 1982

Related U.S. Application Data

[63] Continuation of Ser. No. 212,014, Dec. 1, 1980, abandoned.

[30] Foreign Application Priority Data

Nov. 29, 1979 [GB] United Kingdom ..... 7941164

[51] Int. Cl.[3] ..... B32B 3/02; A46D 1/00

[52] U.S. Cl. ..... 428/96; 156/72; 156/148; 156/254; 428/97; 428/235

[58] Field of Search ..... 156/72, 254, 148, 309.6, 156/253; 428/86, 97, 96, 235; 28/159

[56] References Cited

U.S. PATENT DOCUMENTS

| | | | |
|---|---|---|---|
| 1,785,937 | 12/1930 | Curtis | 156/148 |
| 2,226,631 | 12/1940 | Miller | 428/97 |
| 2,331,321 | 10/1943 | Heaton | 156/148 |
| 3,075,867 | 1/1963 | Cochran | 156/72 |
| 3,347,736 | 10/1967 | Sissons | 428/97 |
| 3,506,530 | 4/1970 | Crosby | 156/148 |
| 3,554,824 | 1/1971 | Callahan | 156/72 |
| 3,837,946 | 9/1974 | Gribbin | 156/254 |
| 3,935,046 | 1/1976 | Kiernan et al. | 156/148 |

*Primary Examiner*—John J. Gallagher

*Attorney, Agent, or Firm*—Gerald J. Ferguson, Jr.; Joseph J. Baker

[57] ABSTRACT

A process of producing a tufted pile fabric comprises providing a primary backing which may be woven, non-woven or knitted fabric and containing for example polypropylene, polyester, polyamide, jute or viscose rayon, applying a meltable fibrous layer to both sides of the primary backing, preferably by needling fibres into the backing, inserting pile tufts into the primary backing so that parts of the pile tufts extend through backing and the meltable fibrous layers and melting the fibrous layer which is on the side of the backing opposite the pile forming surface of the tufts to secure the tufts to the backing and provide an anchor coat for the fabric. The meltable fibre may be polyamide fibre with a melting point in the range 80°-150° C. and may conveniently be Grilon K115 (Grilon is a Registered Trade Mark). The process may be used to provide mother and daughter tufted pile fabrics by applying a second primary backing with meltable fibrous layers applied thereto to the pile forming surface of the first fabric and melting the fibrous layers of the second primary backing to adhere the latter to the pile forming surface of the tufts, and thereafter slitting the tufts intermediate the two primary backings.

16 Claims, 4 Drawing Figures

TUFTED FABRICS AND METHOD OF MAKING

This is a continuation of application Ser. No. 212,014, filed Dec. 1, 1980, now abandoned.

This invention relates to tufted fabrics. In the production of tufted fabrics e.g. carpets, it is common practice to produce such fabrics incorporating a backing membrane of natural material or synthetic plastics material. For example, carpets are produced by having a woven or non-woven membrane e.g. of polypropylene and termed the primary backing into which backing there is inserted, in known fashion, a plurality of tufts in a tufting machine. These tufts, forming the pile of the carpet, extend through the primary backing from one face to the other in the form of loops such that the long loops on one side form the pile of the carpet and the short loops being located on the opposed side of the backing. Cut pile carpet is achieved by cutting the long loops on the face of the carpet. An adhesive coating e.g. of latex is then applied as a primary anchor coat to the side of the primary backing opposite the pile in order to lock the tufts in the primary backing. The necessity for an anchor coat such as latex results in a relatively heavy fabric which, in many cases, lacks adequate flexibility.

It has also been found with such tufted carpets that because the primary backing is frequently of synthetic material and exhibits a surface lustre, there is a tendency for the carpet to exhibit the property of "grinning", particularly where the carpet is laid on a non-flat surface e.g. on stairs. "Grinning" is caused particularly on bending the fabric so that the tufts are separated from each other to expose the surface of the primary backing. In order to counteract this, it has previously been proposed to apply fibrous material to the pile side of the primary backing prior to tufting. This application of fibres has been effected by needle punching as in British Pat. No. 1,228,431, whereby the fibres are laid on the surface of the woven backing fabric and needled into locking engagement with the backing fabric. Once the primary backing is tufted, the fibrous material covers the otherwise exposed surface of the primary backing to reduce grinning.

It has previously been proposed to produce a fabric in which pile tufts are secured to a backing by a layer of thermoplastic fibres provided on the upper side of the backing. Such an arrangement is described, for example, in U.S. Pat. No. 3,325,323 (Forkner) wherein the superimposed layer of thermoplastic fibres is fused after tufting in order to lock the pile tufts to the backing. The thermoplastic layer after fusing is in the form of a continuous surface which is not readily receptive to dyeing and without additional treatment may give rise to the problem of "grinning". In addition, the thermoplastic layer of U.S. Pat. No. 3,325,323, when applied to a backing is secured thereto by thermal bonding. Depending on the materials used for the thermoplastic layer and the backing, a secure bond may not be achieved.

An object of the present invention is to provide a process of producing tufted pile fabrics wherein the necessity for a primary anchor coat is obviated or mitigated.

According to the present invention there is provided a process of producing a tufted pile fabric comprising the steps of providing a primary backing, applying a meltable fibrous layer to both sides of the primary backing, inserting a plurality of pile tufts through said primary backing and meltable fibrous layers so that said pile tufts extend through the primary backing and project on one side of the backing to form the pile, and melting the fibrous layer on at least that side of the backing opposite the pile to secure the tufts in the backing and provide an anchor coat for the fabric. Conveniently, the density of fibres of the meltable, fibrous layer on that side of a primary backing on which the pile tufts are or will be located is less than the density of the meltable, fibrous layer on the other side of the backing.

According to a further aspect of the present invention there is provided a process of producing a tufted pile fabric comprising the steps of providing a first primary backing, applying a meltable fibrous layer to both sides of the first primary backing, inserting a plurality of pile tufts through said first primary backing and said meltable fibrous layers so that the tufts extend through the primary backing and project on one side of the backing to form the pile, applying a meltable fibrous layer to at least one side of a second primary backing, contacting the free ends of the pile tufts with said meltable fibrous layer of the second primary backing, melting the fibrous layers of the first and second primary backings to secure the first and second primary backings to the pile tufts, and slitting the pile tufts intermediate their ends to produce two final fabrics each incorporating one of the primary backings.

According to a further aspect of the invention, there is provided a process of producing a backing fabric suitable for a tufted pile fabric comprising the steps of providing a primary backing, applying a meltable fibrous layer to both sides of the primary backing, the density of the layer on one side of the primary backing being sufficient, when melted, to be capable of locking pile tufts into the backing.

Preferably, the primary backing is a woven fabric, e.g. of synthetic plastics material such as polypropylene, polyester, or polyamide made from tapes, multifilament yarns, spun yarns or combinations of these.

Preferably also the fibrous layer is applied to the primary backing by needling.

A fabric in accordance with the invention incorporates fibre of the order of 100 g/sq. meter as compared to an equivalent weight of 700 g/sq. meter if latex were employed as an anchor coat. The use of a meltable fibre as a locking medium for the tufts rather than latex results in a softer and more flexible product. Additionally, energy requirements are greatly reduced over the latex method.

Embodiments of the present invention will now be described by way of example with reference to the accompanying drawings in which.

Figure 1:
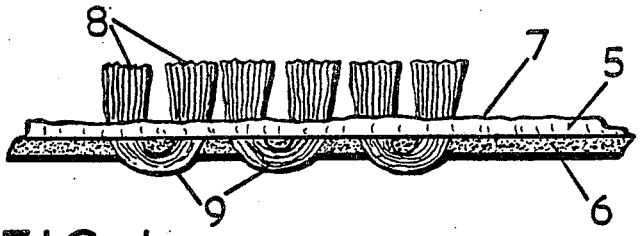
FIG. 1 is a diagrammatic cross-section of a fabric produced in accordance with a first embodiment of the present invention.

Referring to FIG. 1 of the drawing, a carpet is produced by forming a primary backing 5 from a woven polypropylene fabric having 8–40 yarns per sq. cm.

A layer 6 of low melt fibre is applied on at least one surface of the primary backing 5 which is then needled into the polypropylene fabric at a density of 20 to 200 grammes per square centimeter, some of the fibre penetrating through the primary backing 5 to provide a thin fibrous layer 7 on the opposed face of the backing 5 from the layer 6. It has been found convenient to use for layer 6 a fibre such as "Grilon" (Registered Trade Mark) K115 which is a polyamide manufactured by Grilon S. A. and having a melting point of the order of 115° C. and being of 6,7 dtex 60 mm staple length. British Pat. Nos. 1168404 and 1168405 describe the production of "Grilon" (Registered Trade Mark) fibre which can be constituted by a copolyamide having a random distribution of monomer units in the molecule and containing 10 to 60% by weight of monomer units derived from ϵ- caprolactam or ϵ- aminocaproic acid or both, 10 to 50% by weight of monomer units derived from hexamethylene diamine adipate and 5 to 70% by weight of monomer units derived from laurolactam or capriclactam.

When the fibre has been needled into the primary backing 5, the needled backing is then passed to a tufting machine where the tufts are inserted into the backing in normal fashion so that the long ends or loops 8 of the tufts which are to form the pile project on one side of the backing 5 and the interconnecting short loop 9 is located on the other side of the backing which is that side of which the layer 6 of fibres is located.

The composite fabric is then subjected to a heating process sufficient to melt the fibrous layers 6 and 7 but not sufficient to damage the woven polypropylene backing 5 or the material from which the tufts are made. The fibres on being melted, flow into locking engagement with both the backing 5 and the short loops 9 of the tufts and in this way the tufts are locked into the primary backing 5 on cooling of the melted fibrous material.

It will be appreciated that it is an important feature of the present invention that the meltable fibres are needled so as to extend continuously through the primary backing to form the fibrous layers 6 and 7. Consequently, on being melted and subsequently hardened, the needled fibres interlock the pile tufts and the primary backing 5 both thermally and mechanically in a very secure manner. Accordingly, the necessity for a primary anchor coat as in previously proposed processes is eliminated.

Figure 3:
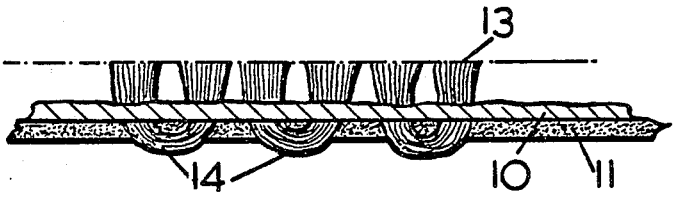
FIGS. 3 and 4 illustrate diagrammatically finished fabrics produced by the process of FIG. 2.
Figure 4:
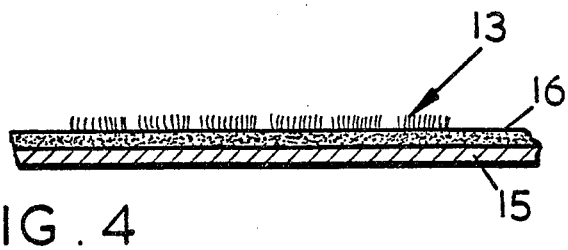

A further embodiment of the present invention is illustrated with reference to FIGS. 2, 3 and 4 of the accompanying drawings. In this embodiment a woven polyamide first primary backing 10 having 8–40 yarns per sq. cm. has a layer 11 of polyamide fibre needle-punched into the primary backing 10 at a density of 20–200 g/m$^2$ so that a thin fibrous layer 12 extends through on to the opposed surface of the primary backing 10. The fibre has a melting point lower than that of the primary backing 10, for example 80–150° C. The needle-punched primary backing 10 is then passed to a tufting machine of conventional form where pile-forming tufts in the form of loops are inserted into the primary backing so that long loops 13 are provided on one side forming the pile and short loops 14 are located on the opposed side of the backing 10.

The free ends of the long loops 13 are then cut to produce a cut pile fabric having a uniformly flat pile surface. The fabric thus formed is then dyed or printed as desired.

Figure 2:
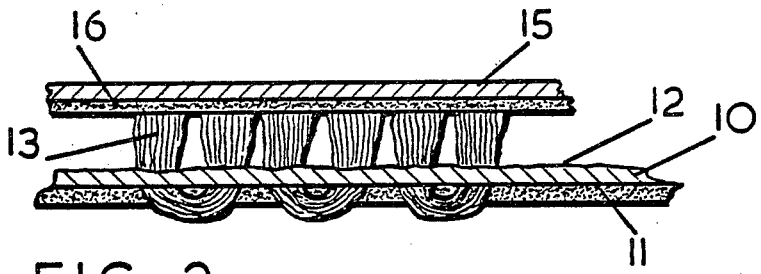
FIG. 2 is a diagrammatic cross-section illustrating an intermediate stage in a process for producing a fabric in accordance with a second embodiment of the present invention.

A second woven polyamide primary backing 15 having 8–40 yarns per sq. cm. and needle-punched with a layer 16 of low melt polyamide fibre at a density of 20 to 200 g/m$^2$ is then superimposed on the cut surface of the pile so that the low melt polyamide fibre of the layer 16 is in contact with the pile ends substantially over the entire surface of the pile as shown in FIG. 2. After application of the second primary backing 15, the composite fabric is maintained in a flat condition so as to avoid creasing. The composite fabric, consisting of the long pile tufts 13 sandwiched between the two-needle punched primary backings 10 and 15, is heated to melt the low melt fibrous layers 11 and 16. Such melting causes the fibrous layer 11 of the first primary backing 10 through which the tufts are inserted to lock the smaller tuft loops 14 to the first primary backing 10. At the same time the low melt fibre of the layer 16 melts and adhesively secures the second primary backing 15 to the ends of the pile tufts 13. Thus the pile-forming tufts 13 are adhesively and securely locked to each of the primary backings 10 and 15 as indicated in FIG. 2.

Once the melted fibre has hardened, the composite fabric is passed to a slitting machine of known form which operates to cut the pile tufts 13 in a direction substantially at right angles to their length and at a location intermediate their ends, in order to produce from the initial composite fabric, two separate final fabrics. As shown in FIG. 3, one of the final fabrics includes the first primary backing 10 and the other final fabric shown in FIG. 4 includes the second primary backing 15. Depending upon the intermediate location between the two layers at which the slit is effected, final fabrics of varying textures can be obtained. For example, by effecting the cut closer to one primary backing than the other, pile thicknesses of 1 millimeter or less can be obtained in one of the final fabrics. Thus from a single intermediate composite fabric, there can be produced two final fabrics such as a short pile fabric suitable for use as an upholstery cloth as well as a longer pile fabric suitable for use as a carpet. Short pile fabric can also be produced to simulate corduroy or velvet.

It will be readily appreciated that the texture of the final fabrics can be varied infinitely depending upon various factors such as the pile length of the intermediate composite fabric, the density and disposition of the tufts initially tufted into the first primary backing by the tufting machine, and the point at which the pile of the intermediate composite fabric is slit between the two primary backings. For example, if sufficiently long pile fabric was used in the intermediate stage, the pile could be slit at a location midway between the two outer primary backings so as to produce two carpets from the intermediate structure, each carpet having a pile length of around half the length of the original tufts inserted.

The primary backing or backings can be woven, non-woven or knitted or, of any other suitable construction and may be made of or contain polypropylene, polyamide, polyester, jute or viscose rayon. Furthermore, the fibre can be of any suitable low melt fibre such as polyvinyl chloride, polyamide, polypropylene, polyethylene or acrylic fibre.

The heating of the fibre can be effected by any suitable means but it is considered that heating by means of heated cylinders, infrared, or radio frequency may be convenient. It will be appreciated, however, that where the fabric is to be kept in a flat condition as in the second embodiment described above, heated cylinders will not be used if it requires the fabric to be passed around the cylinders. In the second embodiment wherein two primary backings incorporating meltable fibre are used, the melting of the fibre on each backing can be effected separately or simultaneously as required.

The process according to the invention can thus be used to eliminate the anchor coat not only in carpets but in tufted upholstery, tufted clothing and tufted wall covering. It will be understood, however that secondary anchor coats and secondary backings (e.g. foam) can be applied to products produced in accordance with the present invention if this is desired e.g. where less flexible products are required.

By the term "low melt" fibre as used herein is meant a fibre which will melt at a temperature sufficiently low to obtain the desired locking effect without detrimentally affecting the primary backing or the tufts. It will be apparent that this temperature will vary according to the materials from which the fibres, primary backing and tufts are made.

The "Grilon" (Registered Trade Mark) K115 fibre referred to in the above-described embodiments has been found to be particularly suitable in the present invention. With previously proposed bonding techniques e.g. spray bonding, a fibrous material is sprayed with a bonding agent over its whole surface. Only a small proportion of the bonding agent, however, performs a bonding function. The greater proportion of the bonding agent covers the fibres of the material and stiffens them. With the "Grilon" fibre as used as a bonding agent in the present invention, the fibre is needled into the backing only to the extent required to provide adequate bonding of the tufts. Consequently, carpets having a needled primary backing in accordance with the invention tends to be lighter in weight than similar carpet backings using spray bonding to secure the tufts. Furthermore, even after melting, the "Grilon" fibre is thermally deformable and is receptive to dyes.

It has been found that the present invention provides a fabric having a layer e.g. of "Grilon" (Registered Trade Mark) K115, on the upper surface of the primary backing which is readily dyed even after being melted. The fibrous layer on the lower surface of the backing after being melted and hardened provides a substantially smooth uninterrupted surface which allows the customary anchor coat to be dispensed with.

What is claimed is:

1. A tufted pile fabric comprising a primary backing, meltable fibrous material needled through said backing to provide a first surface-covering layer on one side of the backing and a second tuft-anchoring layer on the opposed side of the backing, said first and second layers being interconnected through said backing by fibres of said fibrous material, a plurality of pile tufts inserted through the primary backing and said first and second layers, said tufts extending through the backing and projecting on the same side of the backing as said first layer in order to form the pile, and at least said tuft-anchoring layer being melted in order to secure the tufts in the backing and provide an anchor coat for the fabric.

2. A fabric as claimed in claim 1 in which the first surface-covering layer is dye-receptive.

3. A fabric as claimed in any of claim 1 in which the primary backing is a woven, non-woven or knitted fabric.

4. A fabric as claimed in claim 3, in which the fabric contains polypropylene, polyester, polyamide, jute or viscose rayon.

5. A fabric as claimed in claim 1, in which the density of fibres of the first layer is less than the density of fibres of the second layer.

6. A fabric as claimed in claim 1, in which the meltable fibre is a polyamide fibre.

7. A fabric as claimed in claim 6, in which the meltable fibre has a melting point of 80–150° C.

8. A fabric as claimed in claim 6, in which the polyamide is a co-polyamide having a random distribution of monomer units in the molecule and containing 10 to 60% by weight of monomer units derived from ε-caprolactam or ε-aminocaproic acid or both, 10 to 50% by weight of monomer units derived from hexamethylene diamine adipate and 5 to 70% by weight of monomer units derived from laurolactam or capriclactam.

9. A process of producing a tufted pile fabric comprising the steps of providing a primary backing, needling a meltable fibrous material through said backing so as to provide a first surface-covering layer on one side of the backing and a second tuft-anchoring layer on the opposed side of said backing, said first and second layers being interconnected through said backing by fibres of said fibrous material, inserting a plurality of pile tufts through the primary backing and said first and second layers so that said tufts extend through the backing and project on the same side of the backing as said first layer in order to form the pile, and melting at least said second tuft-anchoring layer to secure the tufts in the backing and provide an anchor coat for the fabric.

10. A process as claimed in claim 9, in which the first surface-covering layer is dye-receptive.

11. A process as claimed in any of claim 9, in which the primary backing is a woven, non-woven or knitted fabric.

12. A process as claimed in claim 11, in which the fabric contains polypropylene, polyester, polyamide, jute or viscose rayon.

13. A process as claimed in claim 9, in which the density of fibres of the first layer is less than the density of fibres of the second layer.

14. A process as claimed in claim 9 in which the meltable fibre is a polyamide fibre.

15. A process as claimed in claim 14, in which the meltable fibre has a melting point of 80–150° C.

16. A process as claimed in claim 14, in which the polyamide is a co-polyamide having a random distribution of monomer units in the molecule and containing 10 to 60% by weight of monomer units derived from ε-caprolactam or ε-aminocaproic acid or both, 10 to 50% by weight of monomer units derived from hexamethylene diamine adipate and 5 to 70% by weight of monomer units derived from laurolactam or capriclactam.

* * * * *